US005528965A

United States Patent [19]

Finn

[11] Patent Number: 5,528,965

[45] Date of Patent: Jun. 25, 1996

[54] PARALLEL JAW TOGGLE WRENCH

[76] Inventor: Donald J. Finn, 314 Brown Rd., P.O. Box 1200, Jackson, S.C. 29831-1200

[21] Appl. No.: 392,497

[22] Filed: Feb. 23, 1995

[51] Int. Cl.[6] ..... B25B 7/12

[52] U.S. Cl. ..... 81/356; 81/126; 81/363; 81/373; 81/379

[58] Field of Search ..... 81/356, 373, 461, 81/462, 463, 126, 363, 379

[56] References Cited

U.S. PATENT DOCUMENTS

| | | | |
|---|---|---|---|
| 1,244,967 | 10/1917 | Eifel | 81/356 |
| 1,735,011 | 11/1929 | Plante | 81/356 |
| 2,320,303 | 5/1943 | Ross | 81/356 |
| 2,417,013 | 3/1947 | Pettersen | 81/356 |
| 2,481,435 | 9/1949 | Meunier | 81/356 |
| 2,481,866 | 9/1949 | Petersen | 81/356 |
| 2,556,725 | 6/1951 | Hurlbut | 81/356 |
| 3,340,754 | 9/1967 | Burchett | 81/356 |
| 3,608,405 | 9/1971 | Schmidt | 81/356 |
| 4,274,312 | 6/1981 | Finn | 81/356 |
| 5,094,132 | 3/1992 | Engel | 81/356 |
| 5,289,746 | 3/1994 | Finn | 81/373 |
| 5,385,072 | 1/1995 | Neff | 81/356 |

*Primary Examiner*—Willis Little

*Attorney, Agent, or Firm*—Buchanan Ingersoll; Lynn J. Alstadt

[57] ABSTRACT

A toggle wrench has a first jaw fixed to a handle, a sliding jaw slidable toward and away from the fixed jaw and a leaf spring therebetween. The jaws have parallel pressure surfaces disposed at an angle of 30 degrees with respect to the elongation of the handle. A link is pivotally attached to the sliding jaw and to a carrier. The carrier is positioned along the handle by a manually controllable threaded adjustment assembly mounted on the rearward end of the handle. A lever is pivotally attached to the carrier rearwardly of the link. Movement of the rearward end of the link toward the fixed jaw side of the handle causes forward movement of the link for toggle-pressing the sliding jaw toward the fixed jaw. The carrier holds the lever and link in alignment with the handle.

15 Claims, 3 Drawing Sheets

PARALLEL JAW TOGGLE WRENCH

This invention relates generally to toggle wrenches that are operated by pressing a hand lever toward the handle and more particularly to such a toggle wrench having parallel jaws disposed at an angle of generally thirty degrees relative to the handle thereof.

BACKGROUND OF THE INVENTION

Many wrenches known in the art have had jaws that approach a nut or bolt while being at an angle to each other. This is damaging to the nuts and bolts of good machinery. To overcome this problem the art has developed wrenches having jaw surfaces which move in parallel toward a nut for engaging the flat sides of the nut over broad areas. Parallel jaw adjustable wrenches of the past have operated by the manipulation of worm gears. Such wrenches have a looseness and tend to slip off of a nut while great wrenching pressure is being applied. The sudden release of pressure causes an operator's hand to fly through the air, often cutting the operator's knuckles on adjacent machinery. Consequently, these wrenches are nick-named "knuckle-busters". Thus, there is a need for a wrench which has the advantages of parallel jaws combined with the high gripping.

Most nuts for which wrenches are used today have either a square or hexagonal shape. A hexagonal nut has two surfaces at each corner that lie in planes 120 degrees apart. For that reason wrenches which have a handle at a 30 degree angle relative to the jaws are more effective. This angle also permits the wrench to be used more easily on nuts which are in such tight spots that a 60 degree wrenching stroke is not possible.

In my U.S. Pat. No. 5,289,746, issued Mar. 1, 1994, I disclose a parallel jaw toggle wrench that has a first jaw fixed to a handle and a second sliding jaw slidable toward and away from the fixed jaw. The first and second jaws have parallel pressure surfaces disposed at an angle of thirty degrees with respect to the elongation of the handle. A link is pivotally mounted to the forward end of the lever and has a forward end pivotally attached to the sliding jaw. A carrier is moved along the handle by a manually controllable adjustment assembly mounted on the rearward end of the handle. The lever is pivotally attached to the carrier, rearward of the link. A movement of the rearward end of the link toward the fixed jaw side of the handle, causes forward movement of the link for toggle-pressing the sliding jaw toward the fixed jaw. In that wrench the jaws are biased to an open position by a spring extending between the lower jaw and the handle. Such a configuration requires that the wrench body be shaped differently from popular wrenches used by mechanics.

SUMMARY OF THE INVENTION

The present wrench is similar to that disclosed in U.S. Pat. No. 5,289,746. However, a leaf spring is provided between the jaws. This wrench also preferably has a lock nut on the adjustment bolt and a retaining clip that fits over the carrier. Use of the leaf spring and carrier clip provides a thinner, tighter design and enables the body of the wrench to have an appearance that corresponds to other adjustable wrenches.

DESCRIPTION OF THE PREFERRED EMBODIMENTS

Figure 1:
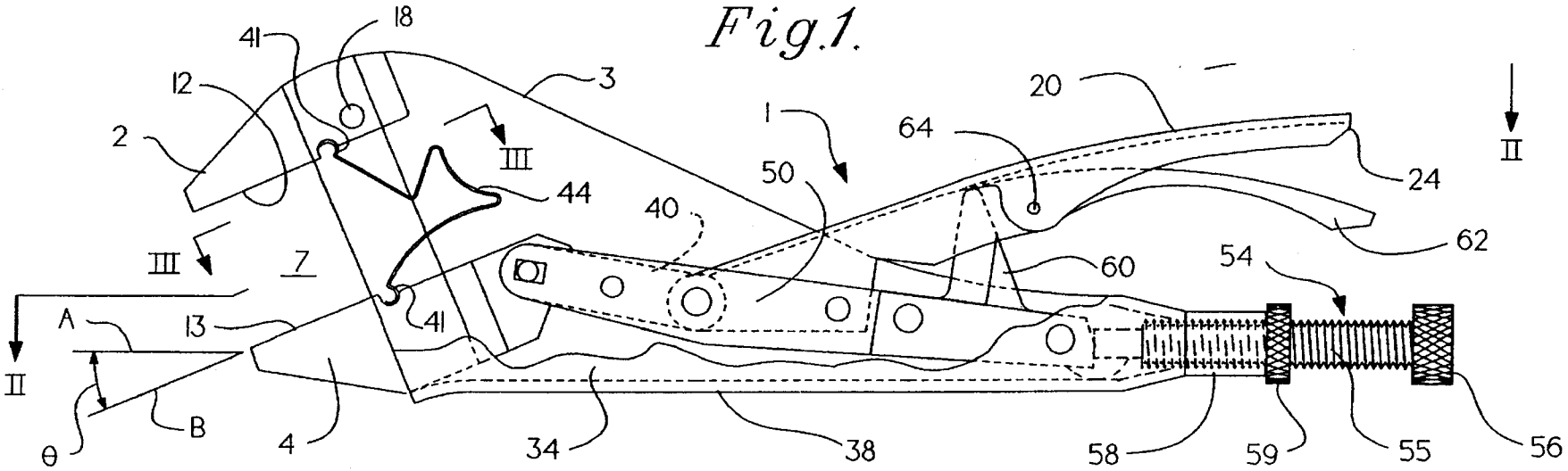
FIG. 1 is a side elevational view partially cut away of a present preferred embodiment of my wrench.

The first present preferred embodiment of my wrench shown in FIGS. 1 thru 4 has a jaw 2 and sliding jaw 4. An elongated handle 3 extends rearwardly from the fixed jaw 2. The handle 3, is preferably one piece of steel and has right and left spaced sidewalls 34 connected together by a bottom wall 38.

The fixed jaw 2 has a forwardly extending first pressure surface 12 and a forward terminal end 14. The fixed jaw 2 is attached to the handle 3 by suitable means such as a rivet 18, and also held by right and left tracks 16 welded to insides of the right and left handle sidewalls 34. The sliding jaw 4 has a forwardly extending pressure surface 13. The parallel pressure surfaces 12 and 13 of the jaws, when in the jaws-open position as shown in FIG. 1 define with the handle 3 a rectangular opening 7.

Figure 3:
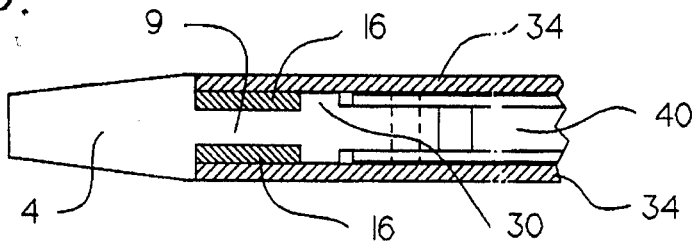
FIG. 3 is a sectional view along the line III—III of FIG. 1 after the spring between the jaws has been removed.

As shown in FIG. 3, the sliding jaw 4 has narrow portion 9 between and closely fitting the tracks 16 by means of left and right track-receiving jaw-notches 10 and has a rearward track follower portion 30 cooperatively correlated with the tracks 16. Notches receive the tracks respectively and thereby slidably secure the jaw to the tracks 16 for sliding of the sliding jaw 4 toward and away from the fixed jaw 3 while the sliding jaw compression surface 13 is always maintained transverse to the elongation of the main handle 3 and opposite and parallel to the fixed jaw surface 12.

An elongated rearwardly extending hand lever 20 has a forward portion 22 between the handle sidewalls 34 and a rearward portion 24 protruding from the handle 3 at its upper side.

Figure 2:
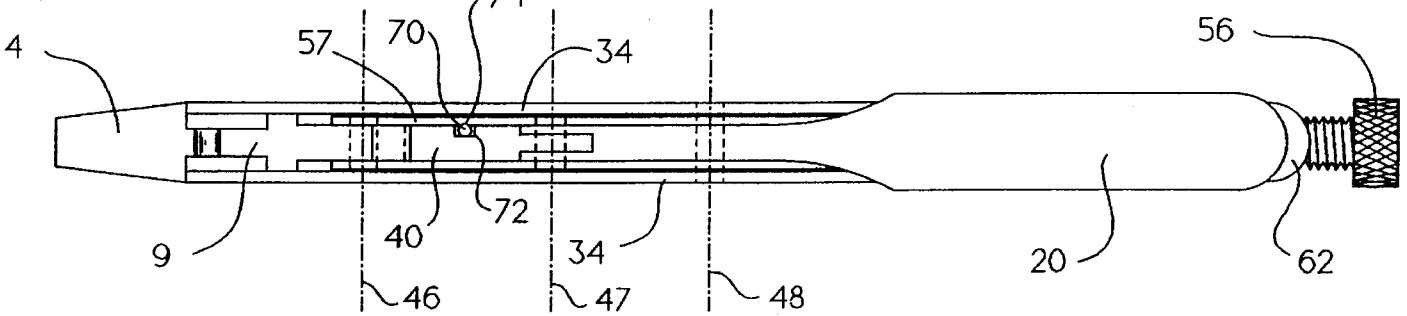
FIG. 2 is a top view partially cut away of the wrench shown in FIG. 1 after the spring has been removed from between the jaws.

A link 40 has a forward end pivotally attached by a horizontal pivot pin 45 to the rear portion 11 of the sliding jaw 4 in a manner which permits pivoting of the link about a forward axis 46 shown in chain line in FIG. 2 disposed transversely to the elongation of the handle 3. The pivot pin 45 at the forward axis 46 must be a pin, and not a rivet, because there is no room for a rivet head if the forward head end of the wrench is to be made compact and thin for tight places. The pin 45 is held in place by the handle sidewalls 34 in all handle positions. But the pivot pin 45 will fall out when the lever 20 is moved to the down position at its forward end if the carrier sides are of uniform vertical dimension in side elevation. So to solve this a special extra vertical height is provided on the carrier sidewalls in the area of the forward pin 45.

The hand lever 20 is pivotally secured to the rearward end of the link 40 for rotation about an intermediate axis 47. The hand lever 20 is elongated and is generally in parallel with the handle 3 and has a forward portion movably disposed between the sidewalls 34 of the handle 3.

A carrier 50 is disposed between sidewalls 34 of handle 3. A pivot pin 52 pivotally attaches the lever 20 to the carrier 50 for the pivoting of the lever 20 about a rearward axis 48. Pin 43 connects the link 40 to the carrier at intermediate axis 47. The axes 46, 47 and 48 are parallel and normal to the elongation of the handle 3.

A threaded assembly 54 is mounted on the rearward end of the handle 3 and has a manually movable adjustment portion defined by a bolt 55 having a manually rotatable control 56. The threaded assembly 54 and specifically the bolt 55 thereof is operatively correlated with respect to the carrier 50. External threads of the bolt 55 engage internal threads of a tubular portion 58 forming the rearward end of the handle 3.

The forward end of the bolt 55 engages the rearward end of the carrier 50. Movement of the adjustment bolt 55 forward and rearward will cause the carrier 50 to move forwardly and rearwardly. I prefer to provide a lock nut 59 on the bolt 55.

The sliding jaw 4 with link 40 and the lever 20 attached to inside of carrier 50 together define an interconnected assembly. A leaf spring 44 is connected between the fixed jaw 2 and sliding jaw 4 and urges the sliding jaw 4 away from fixed jaw 2. As the sliding jaw 4 is moved toward and away from the fixed jaw 2, the arcuate ends 41 of the spring 44 will rotate within curved recesses in the jaws in which these ends are seated. The spring 44 serves not only to open the jaws but also to keep the carrier 50 in engagement with the adjustment bolt 55.

The carrier 50 has two parallel spaced sidewalls 52 which are of flat stock and which are held in spaced parallel positions at the sides of a spacer 60 which has flat vertical sides. The spacer 60 is secured to the sidewalls 57 of the carrier 50 by a pair of rivets 67. The spacer 60 has a lower lip 63 which protrudes rearwardly under the forward end of the bolt 55. The spacer 60 has a hump extending upwardly into a position for engaging the underside of the forward end of a release 62 which is elongated forwardly and rearwardly. The release 62 pivots on a horizontal axle 64 extending through the sidewalls of lever 20. The axle 64 extends normally to the length of the lever 20. The forward end of lever 20 can press down on the hump of spacer 60 to release the toggle action when the rearward end of the release 62 is raised up.

In FIG. 1, the elongation of the handle 3, as represented by a straight line A parallel with the substantially straight underside of the handle 3 is at an angle θ of 30 degrees, with respect to the pressure surfaces of the jaws as represented by a line B. An angle of 30 degrees permits the wrench to efficiently work in a very tight spot by the turning of the wrench over between each wrenching stroke.

Although not required, I prefer to provide a ball 70 operatively correlated between the carrier 50 and the link 40 to hold the moving parts in an overcomeable restraint. As shown in FIG. 2, the ball 70 is disposed in a cavity 72. A spring may be placed in the cavity 72 to urge the ball toward and into a recess 74 on the inner side of a carrier sidewall 57.

The carrier 50 has substantially similar right and left slots 51 in its sidewalls 53, the slots 51 receive right and left ends of the pin 45 so that the forward end of the carrier 50 is held in position by pin 45. The carrier 50 must extend downward to provide support for the pin 45 and keep the pin from sliding out of place. The walls of the slots 51 should closely fit the pin 45 as measured transversely to the handle elongation. Preferably, the slots 51 extend rearwardly 3/32" beyond the pin 45 when the parts are in the clamping position of FIG. 1 so that the carrier 50 does not interfere with the upward pressure of link 40 on the sliding jaw 4.

I prefer to make the handle 3 of a U-shaped configuration. A wrench with such a handle is distinguished by being very rigid, very strong, and substantially without any bending, or "give" or, "springing".

Figure 7:
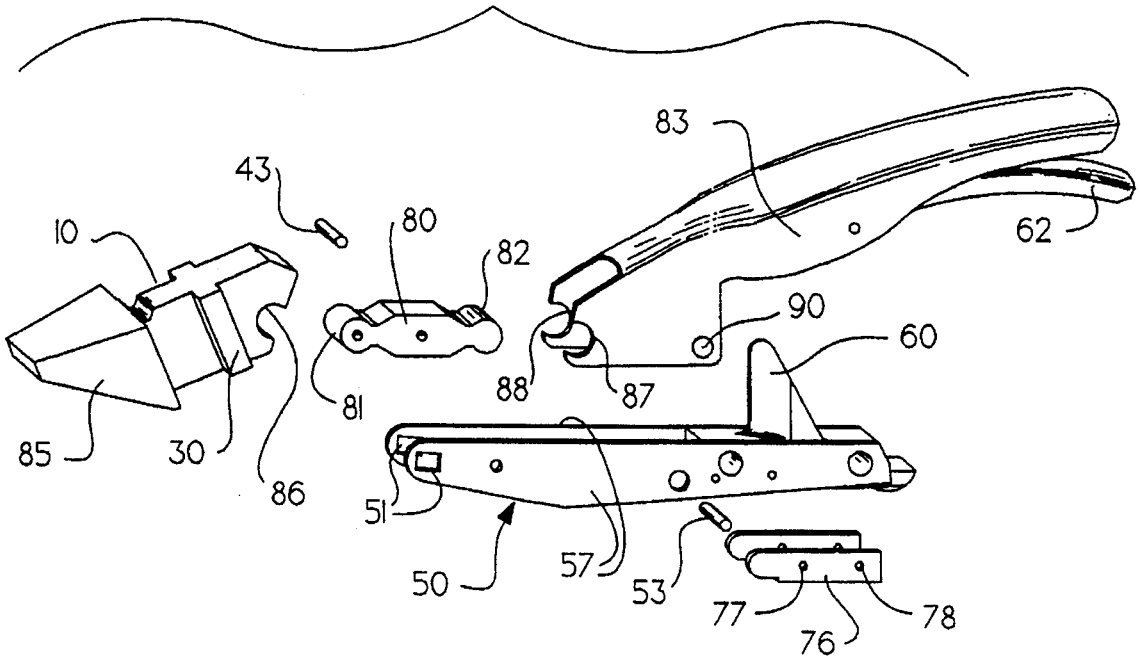
FIG. 7 is an exploded perspective view of the interconnected assembly of the sliding jaw, link, lever and carrier in the wrench of FIG. 5.
Figure 5:
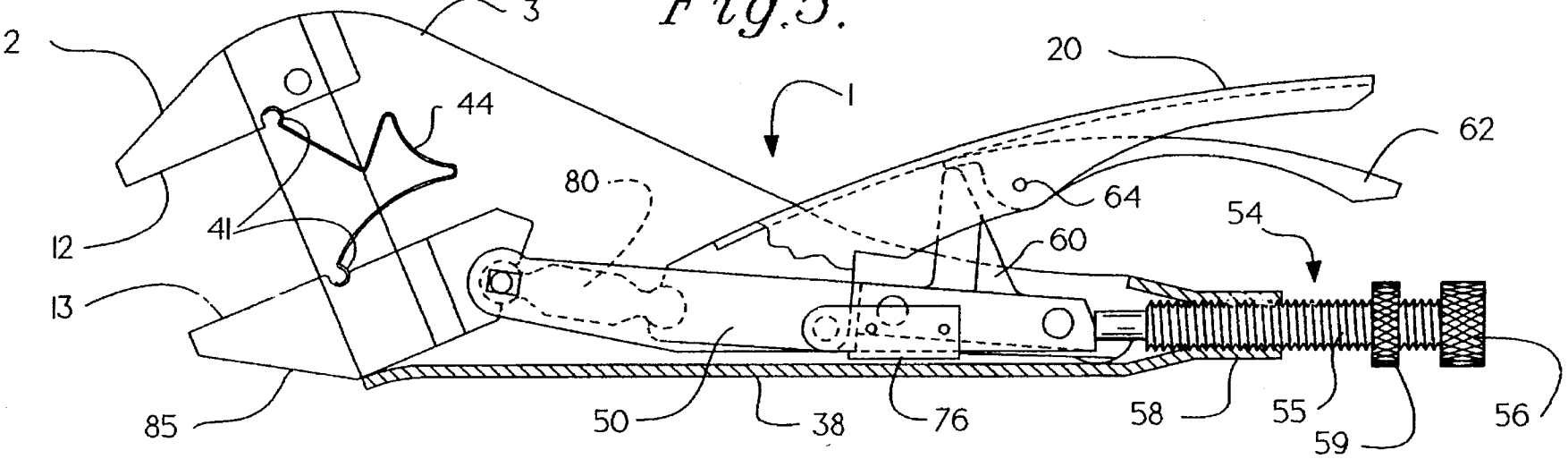
FIG. 5 is a side elevational view of an alternate embodiment of the invention partially cut away.
Figure 6:
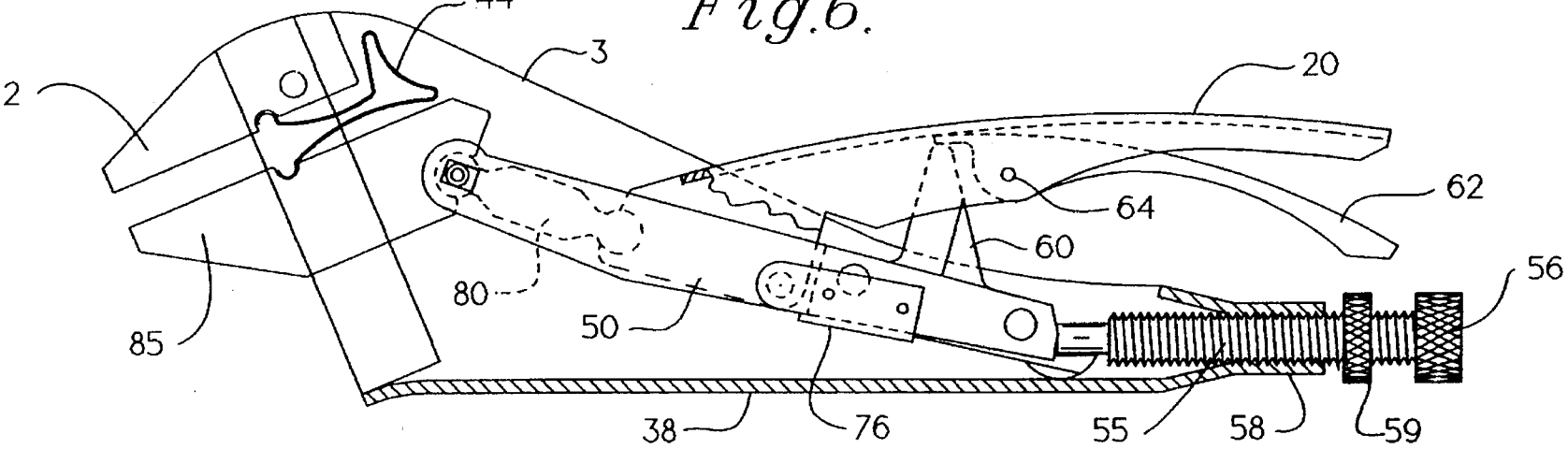
FIG. 6 is a side view of the wrench of FIG. 5 with the adjustment screw moved forward for partially closing the jaws.

FIGS. 5 through 7 illustrate an alternate embodiment of the invention wherein like reference numerals are used to designate like parts of both embodiments. FIG. 5 is a side view of the wrench assembly of the alternative embodiment showing the hidden parts in dotted lines. FIG. 6 is similar to FIG. 5 with the exception that handle 84 has been moved to the closed position and the sliding jaw 85 has moved into the forward nut engagement position. In this embodiment the sliding jaw 85 has a rearward opening socket 86. Rearward opening socket 86 is adapted to slidably receive rounded forward end 81 of link 80. The link 80 is created at a different angle relative to the sliding jaw 85 than in the first embodiment. This allows the wrench to have a sharper pitch angle of the top surface 79 relative to the sliding jaw 85. This angle corresponds closely to the pitch of nearly all commercially available adjustable wrenches. Lever 83 has forwardly facing sockets 87 and 88 (FIG. 7) formed in the forward end thereof which are adapted to slidably receive the rearward rounded end 82 of link 80. I prefer to provide a filler in lever 83.

One improvement afforded by this embodiment is that the link 80 requires no pins for connection to the sliding jaw 85 and to the lever 83. Rather, the forward end 81 of link 80 is rounded for pivotal receipt within a rearwardly opening socket 86 in sliding jaw 85. The ends of socket 86 extend over center with respect to a radial line through either of them, so as to pivotally retain the forward end of the link 80 therein. Likewise, the rearward end 82 of link 80 is rounded for pivotal receipt within forwardly facing sockets 87 and 88 formed in the forward end of lever 83. This eliminates another pinned connection. More importantly, the interconnected assembly is made stronger and may be manufactured much less expensively than the embodiment of FIGS. 1 thru 4 since the link, lever and carrier can all be punched out with a punch press. Furthermore, the pivot pin 43 may have the central portion thereof which goes through the hole in the link knurled so that the tolerance need not be so exact.

Figure 4:
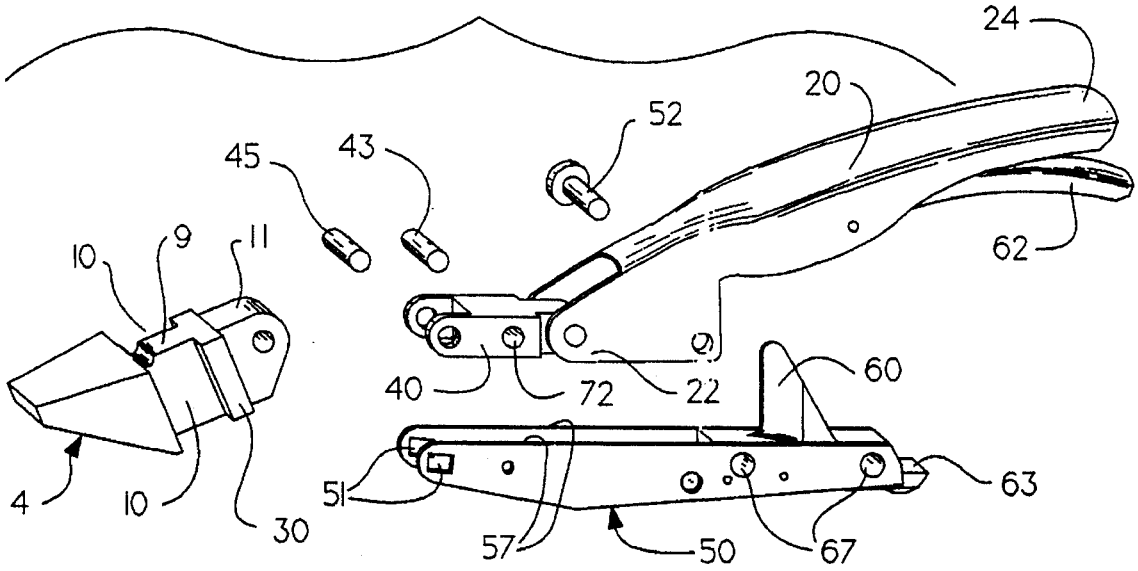
FIG. 4 is an exploded perspective view of the interconnected assembly of the sliding jaw, link, lever and carrier.

As can be seen most clearly by comparing FIGS. 4 and 7, link 40 of the first embodiment has been replaced with link 80. Additionally, lever 20 has been replaced with lever 83 and sliding jaw 5 has been replaced with sliding jaw 85. As described above, sliding jaw 85 has a rearwardly opening socket 86 adapted to slidably receive the forward rounded end 81 of link 80. Lever 83 has been modified to comprise forwardly facing sockets 87 and 88 adapted to slidably receive rounded end 82 of link 80. As mentioned above this improvement eliminates the requirement of pins 45 and 52 shown in FIG. 4 to connect sliding jaw 85 and lever 83 to link 80. Additionally, a retaining clip 76 having dimples 77 and 78 is provided to retain pin 53 which passes through carrier 50 and hole 90 in lever 83 to hold the lever 83 in place. This enables the wrench to be made with an allowance of only 0.009 inches between the carrier and the sidewalls of the wrench. Such a tight fit eliminates any give when using the wrench and provides a pleasing appearance.

Those skilled in the art will recognize that numerous other modifications and variations of the present invention are possible in view of the above teachings. Therefore, it is to be understood that the above description is representative of only two of the several possible embodiments of the invention within the scope of the following claims.

I claim:

1. A toggle wrench comprising:

a fixed jaw;

an elongated handle extending rearwardly from said fixed jaw and attached thereto, said handle having spaced right and left connected sidewalls, and a lower closed side and an opposite upper side adjacent said fixed jaw;

a sliding jaw below said fixed jaw, said jaws having forwardly extending pressure surfaces;

a track system mounted on said handle and having right and left tracks mounted on said right and left sidewalls respectively and elongated transversely of said pressure surfaces, said sliding jaw being guided by said tracks;

an elongated rearwardly extending hand lever having a forward portion movable between said sidewalls and a rearward portion protruding from said sidewalls on the upper side of said handle;

a link having a forward end pivotally attached to a rearward portion of said sliding jaw in a manner for the pivoting of said link about a forward axis, the forward end of said lever being pivotally secured to the rearward end of said link for rotation about an intermediate axis, said link being free of any direct pivotal connection to said handle;

a carrier elongated in parallelism with said handle and disposed between its said sidewalls;

means pivotally attaching said lever to said carrier for pivoting about a rearward axis rearwardly of said intermediate axis, said axes being parallel to each other and also being normal to the elongation of said handle;

connection means on said carrier and said forward end of the link whereby said forward end of the link is movable fore and aft relative to said carrier;

resilient means operably connected between said sliding jaw and said fixed jaw for urging said sliding jaw away from said fixed jaw, the forward end of said hand lever moving upwardly in response to downward pivotal movement of a rearward end of said lever about said rearward axis, thereby moving said intermediate axis toward a line between said forward and rearward axes and moving said forward end of said link relative to said carrier and thereby forcing said movable jaw toward said fixed jaw against the urging of said resilient means; and a threaded assembly mounted on the rearward end of said handle and having a manually rotatable adjustment portion movable fore and aft of said handle in response to threaded rotation thereof, said adjustment portion and carrier having coacting engagement surfaces such that forward threading movement of said adjustment portion forces said carrier to move forward toward said sliding jaw, said sliding jaw, link, lever, and carrier together defining an interconnected assembly.

2. The wrench of claim 1 having said jaw pressure surfaces disposed at an angle of 30° with respect to the elongation of said handle.

3. The wrench of claim 1 wherein said carrier has sidewalls extending along said opposite sides of said lever and of said link and serving to give support to and restrain said lever and said link from bending.

4. The wrench of claim 3 wherein said pin and slot connection means includes a slot in the forward end of said carrier sidewalls and, a pivot pin extending into said carrier sidewall slots for holding said carrier in position to give said support yet fitting said slots loosely enough that said lever can deliver pressure forward on said link greater than any effect of said carrier sidewalls on said link causing the forward end of said carrier to follow said sliding jaw.

5. The wrench of claim 4 wherein said carrier sidewall slots receive opposite ends of said pivot pin and extend generally transversely of said handle, said slots extending rearwardly beyond said pivot pins sufficiently that said carrier does not interfere with application of pressure by said link onto said lower jaw to urge it toward said fixed jaw.

6. The wrench of claim 5 further comprising an intermediate pin pivotally connecting the forward end of said lever to the rearward end of said link and said carrier sidewalls overlapping said forward pin and said intermediate pin so as to prevent them for sliding out of said link.

7. The wrench of claim 5 further comprising a carrier spacer between said carrier sidewalls and having a hump extending upwardly, a release pivoted on said lever and engaging said hump and capable of causing a release jaw pressure by pressing on said hump.

8. The wrench of claim 3 having a spring-urged ball detente assembly exerting pressure to lock the forward end of said lever in a fixed down position with respect to said handle when said axes are in alignment, said ball detente assembly preventing said handle from flying outward when said wrench is used in a non-clamping manner as an adjustable wrench, said ball detente assembly comprising a ball disposed between said forward axis and said intermediate axis and mounted in said link, said carrier having a recess on an inner side of one of its said sidewalls and releasably receiving a part of said ball when said forward end of said lever is in said down position.

9. The wrench of claim 1 wherein said link comprises generally rounded forward and rearward positions and wherein said sliding jaw comprises a rearward opening socket extending over center with respect to a line drawn therethrough and wherein said socket is adapted to slidably receive and pivotally retain said rounded forward portion of said link.

10. The wrench of claim 9 wherein said hand lever comprises forward opening sockets extending over center with respect to a line drawn therethrough and adapted to slidably receive and pivotally retain said rearward rounded portion of said link.

11. The wrench of claim 1 also comprising a lock nut attached to a threaded assembly.

12. The wrench of claim 1 wherein the means pivotally attaching said lever to said carrier is a retainer clip.

13. A toggle wrench comprising:

a fixed jaw;

an elongated handle extending rearwardly from said fixed jaw and attached thereto, said handle having spaced right and left connected sidewalls, and a lower closed side and an opposite upper side adjacent said fixed jaw;

a sliding jaw below said fixed jaw, said jaws having forwardly extending pressure surfaces;

a track system mounted on said handle and having right and left tracks mounted on said right and left sidewalls respectively and elongated transversely of said pressure surfaces, said sliding jaw being guided by said tracks;

an elongated rearwardly extending hand lever having a forward portion movable between said sidewalls and a rearward portion protruding from said sidewalls on the upper side of said handle;

a linkage having a forward end pivotally attached to a rearward portion of said sliding jaw and a rearward end attached to said lever;

resilient means operably connected between said sliding jaw and said fixed jaw for urging said sliding jaw away from said fixed jaw; and a threaded assembly mounted on the rearward end of said handle and having a manually rotatable adjustment portion movable fore and aft of said handle in response to threaded rotation thereof, said adjustment portion and linkage having coacting engagement surfaces such that forward threading movement of said adjustment portion forces said linkage to move forward toward said sliding jaw, said sliding jaw, linkage and lever together defining an interconnected assembly.

14. The wrench of claim 13 having said jaw pressure surfaces disposed at an angle of 30° with respect to the elongation of said handle.

15. The wrench of claim 13 also comprising a lock nut attached to a threaded assembly.

* * * * *